US005775781A

United States Patent [19]

Sawtelle et al.

[11] Patent Number: 5,775,781

[45] Date of Patent: Jul. 7, 1998

[54] PAVEMENT MARKING REMOVAL TOOL AND METHOD

[75] Inventors: Randy R. Sawtelle, 355 Paint Fork Rd., Barnardsville, N.C. 28709; Ronald D. Mills, Yorba Linda, Calif.

[73] Assignee: Randy R. Sawtelle, Barnardsville, N.C.

[21] Appl. No.: 791,415

[22] Filed: Jan. 24, 1997

Related U.S. Application Data

[60] Provisional application No. 60/011,152, Jan. 26, 1996.

[51] Int. Cl.[6] ..... E01C 23/088

[52] U.S. Cl. ..... 299/39.8; 299/39.9

[58] Field of Search ..... 299/39.4, 39.8, 299/39.9, 87.1; 404/90, 91, 94

[56] References Cited

U.S. PATENT DOCUMENTS

| | | | |
|---|---|---|---|
| 2,576,607 | 11/1951 | Knudson et al. | 299/39.8 |
| 2,990,660 | 7/1961 | Hatcher | 299/39.4 |
| 3,045,992 | 7/1962 | Asbury | 299/39.7 |
| 3,598,446 | 8/1971 | Hatcher | 299/39.2 |
| 3,695,723 | 10/1972 | Kita et al. | 299/40.1 |

(List continued on next page.)

OTHER PUBLICATIONS

Pavement Repair with the Bobcat Planer, A User's Guide, Melroe Company. (undated).

Bobcat & Bob–Tach . . . brochure, Melroe Company. (undated).

Surface Preparation Equipment brochure, SASE Company, Seattle, Washington. (undated).

Cold Planer CP416/CP424 brochure, Gehl Company, West Bend, Wisconsin. (1995).

TLR 1000 Line Eraser brochure, Line Master Engineering, Inc., Long Beach, California. (undated).

Turbo Blast brochure, Dickson Industries, Inc., Tecumseh, Oklahoma. (undated).

Starjet brochure, NLB Corp., Wixom, Michigan (Aug. 1995).

Road & Trenching Carbide Bits & Blocks, (excerpt from Catalog 805), Fansteel, VR/Wesson Mining & Construction Tools, Lexington, Kentucky.

Remove–It Drum brochure, Ranjo's Inc., (not prior art; a description of subject invention). (undated).

*Primary Examiner*—David J. Bagnell

*Attorney, Agent, or Firm*—Carter & Schnedler, P.A.

[57] ABSTRACT

A method for removing pavement marking and a drum unit for use in practicing the method. The drum unit is mounted in a drive unit on a horizontal rotational axis. A plurality of cutting bit holders, known as blocks, are secured to the outer cylindrical surface of the drum, and there are a plurality of cutting bits that can be repeatedly installed in and removed from the holders. The blocks and cutting bits are arranged so as to produce chipping grooves in pavement sufficiently closely spaced for removing pavement markings and a thin layer of underlying pavement, while leaving an acceptably smooth surface. To produce the sufficiently closely spaced chipping grooves on pavement, the holders and cutting bits are arranged in a regular pattern with interlacing (also referred to as "lacing" or "flighting"). The holders and bits produce chipping grooves on pavement that are laterally spaced within approximately ½ inch of each other, and preferably closer. Preferably, the holders and cutting bits are arranged in a repeating chevron pattern, oriented for lateral movement of removed marking and pavement material towards the ends of the unit.

8 Claims, 5 Drawing Sheets

U.S. PATENT DOCUMENTS

| | | | |
|---|---|---|---|
| 3,975,055 | 8/1976 | Wirtgen | 299/39.6 |
| 4,175,886 | 11/1979 | Moench et al. | 404/90 |
| 4,193,636 | 3/1980 | Jakob | 299/39.2 |
| 4,325,580 | 4/1982 | Swisher, Jr. et al. | 299/39.8 |
| 4,333,685 | 6/1982 | Arnswald | 299/39.4 |
| 4,389,074 | 6/1983 | Greenfield | 299/113 |
| 4,497,520 | 2/1985 | Ojanen | 299/111 |
| 4,523,361 | 6/1985 | Dummermuth | 29/81.05 |
| 4,646,481 | 3/1987 | Dickson | 451/87 |
| 4,693,041 | 9/1987 | Dickson | 451/87 |
| 4,704,045 | 11/1987 | Taylor et al. | 404/90 |
| 4,753,052 | 6/1988 | Dickson | 451/87 |
| 4,788,799 | 12/1988 | Dickson | 451/87 |
| 4,822,107 | 4/1989 | Connacher | 299/39.8 X |
| 4,826,352 | 5/1989 | Wirtgen | 404/90 |
| 4,834,463 | 5/1989 | Nye | 299/39.2 |
| 4,841,681 | 6/1989 | Dickson | 451/37 |
| 4,896,995 | 1/1990 | Simmons | 404/90 |
| 4,946,307 | 8/1990 | Jakob | 404/92 |
| 4,966,418 | 10/1990 | Wirtgen | 299/39.2 |
| 5,028,170 | 7/1991 | Gorski et al. | 404/72 |
| 5,078,540 | 1/1992 | Jakob et al. | 404/90 |
| 5,236,278 | 8/1993 | Dickson | 404/90 |
| 5,263,769 | 11/1993 | Pharr et al. | 299/39.6 |
| 5,354,146 | 10/1994 | O'Konek | 299/39.2 |
| 5,536,073 | 7/1996 | Sulosky et al. | 299/87.1 X |
| 5,676,490 | 10/1997 | Nelson | 299/39.4 X |

PAVEMENT MARKING REMOVAL TOOL AND METHOD

CROSS REFERENCE TO PROVISIONAL PATENT APPLICATION

The benefit of U.S. Provisional application Ser. No. 60/011,152, filed Jan. 26, 1996, is claimed.

BACKGROUND OF THE INVENTION

The present invention relates generally to the removal of markings from paved surfaces such as roadways and parking lots and, more particularly, to efficient methods and tools for removing a variety of markings from pavement.

Various pavement marking techniques are known, including the use of traffic paint, thermoplastic, epoxy paint and preformed tapes. Common pavement surfaces are asphalt and concrete. Most pavement marking systems are intended to be as durable and permanent as possible, and resistant to weathering and wear from traffic.

There is a need for efficient removal of pavement markings, for example when traffic lanes are reconfigured or parking lots are rearranged. In view of the intended permanent nature of most pavement markings, removal of pavement markings is a more difficult and demanding task than might be supposed. For example, paint, when used for roadway marking, penetrates into the pavement, perhaps ⅛ inch, so that mere surface removal of the paint is not sufficient to remove the marking. Moreover, pavement marking removal techniques which work on one pavement type or with one line marking type may not work as well on others. For example, a pavement marking removal technique which generates excessive heat, while suitable for removing painted markings, can melt thermoplastic, causing equipment to gum up.

Pavement marking removal machines typically employ various forms of cutting devices to remove the marking material, as well as an underlying thin layer of pavement material, for example, ⅛ inch, in order to effectively remove painted lines, including paint which has penetrated the pavement. The removal of only ⅛ inch of pavement surface is generally acceptable, provided a smooth surface is maintained. With normal traffic wear, the areas where markings have been removed become less and less discernable over time.

Perhaps the most common type of machine employed for removing pavement marking is known as a "Road Pro", manufactured by Dickson Industries, Inc., of Tecumseh, Oklahoma, as is for example disclosed in Dickson U.S. Pat. No. 5,236,278. Various other companies make similar machines.

Briefly, in a "Road Pro"-type machine, parallel passive shafts extend between circular rotating end plates. The parallel passive shafts are attached near the peripheral edges of the end plates, thus defining a cage-like circumferentially spaced array. Hardened steel star wheels are carried on the parallel passive shafts, and these star wheels strike and abrade the pavement surface.

While the "Road Pro"-type machine is widely employed, it nevertheless is subject to a number of disadvantages. The machine is relatively slow. The star wheels wear out relatively quickly, and accordingly must be replaced on a regular maintenance basis. Further, the "Road Pro"-type machine is primarily for use in removing painted pavement markings, and tends to gum up on thermoplastic, which melts rather than being abraded to a powder or chips. In addition, an objectionable fine dust is produced during the removal process.

Another type of machine commonly employed for removing pavement markings is represented by the "PM Eraser®", manufactured by PaveMark Corporation, of Atlanta, Georgia. Similar machines are manufactured by other companies, such as the Model No. TLR 1000 Line Eraser manufactured by Line Masters™ Engineering, Inc., of Long Beach, Calif. Machines of the "PM Eraser"-type employ a rotary cutting head on a primary vertical rotational axle, with a central hub supporting three equally-spaced radial sub-axles. Each of the sub-axles supports several rotating and cutting heads having carbide tips (which rotate on spinning horizontal axes while the entire assembly is rotating on the vertical axis).

The "PM Eraser"-type machine is likewise subject to a number of disadvantages. Like the "Road Pro"-type machine, the "PM Eraser"-type machine is not efficient on thermoplastic, and additionally is relatively slow. Although the manufacturers claim significantly greater rates, on difficult pavement markings, such as thermoplastic, the machine may slow down to a rate of only 25 feet per hour. Additionally, the "PM Eraser"-type machine leaves a relatively rough marking on the pavement. The "PM Eraser"-type machine is a walk-behind machine, not readily mountable on a vehicle.

Another approach to pavement marking removal, which is effective on concrete surfaces, is to employ a set of diamond saw blades arranged to make a dado cut. While diamond saw blades perform very well on concrete for removing pavement markings, there is no particular benefit on asphalt pavement surfaces, and they tend to bind up on thermoplastic pavement markings. Diamond saw blades are also relatively costly.

Further evidencing the difficulty of removing pavement markings, other machines which have been employed are shot blast machines which employ steel abrasive particles, and high-pressure water jet machines. An example of a shot blast machine is the "Turbo Blast", also manufactured by Dixon Industries, Inc., of Tecumseh, Oklahoma. An example of a high-pressure water jet machine is the "Starjet™", manufactured by NLB Corp., of Wixom, Mich.

Although a relatively different operation, deserving mention in the context of the subject invention are asphalt milling or planing machines, which are employed for pavement repair. Asphalt milling or planing machines can remove up to several inches of pavement material, and deliberately leave a relatively rough surface for better bonding of new asphalt or other repaving material. Asphalt milling or planing machines come in two general sizes, large and small. The large machines are wide enough to plane a strip of roadway approximately six feet wide in one pass. The smaller machines, typically sixteen inches in width, are used behind the large machines for touch up work.

An example of a typical smaller machine is a "Bobcat Planer", manufactured by Melroe Company. Although called a "planer," the device actually chips pavement.

A "Bobcat Planer" is attached to a vehicle, such as a "Bobcat skid-steer loader", and includes a drum unit which rotates on a horizontal axis within a suitable hydraulically-powered drive unit. On the outer cylindrical surface of the planer drum are a plurality of relatively large cutting bits removably secured in suitable holders and arranged in a random pattern. "Bobcat Planers" are not suitable for removal of pavement markings because an unacceptably rough roadway surface is produced. The "Bobcat Planer" however is well suited for its intended purpose, removal of pavement to a desired depth while leaving a rough surface prior to repaving.

SUMMARY OF THE INVENTION

Briefly, and in accordance with one aspect of the invention, it is recognized that a planer or asphalt milling type drum, when provided with sufficiently small and numerous teeth, particularly in an appropriate pattern, can be employed for effective and highly acceptable removal of pavement markings. A relatively thin, for example ⅛ inch, layer of pavement is removed, and the resulting surface is acceptable to highway departments.

Advantageously, the drum can be mounted to a vehicle such as a "Bobcat skid-steer loader", in place of a "Bobcat Planer" drum, thus providing a convenient means for running the drum over a pavement surface. Although an acceptably smooth surface is produced, chips are produced rather than fine powder as in typical prior-art pavement marking line removal machines. There are two benefits in particular. First, the chips are not nearly as objectionable as is fine dust. Second, the resulting process generates far less heat, so that thermoplastic pavement markings are not melted but, rather, are chipped away.

The method and tool of the invention remove both painted and thermoplastic pavement markings with the same effectiveness. Thus, even thermoplastic pavement markings can be removed at a rate of 5,000 feet per hour when employing the subject invention.

More particularly, a method for removing pavement markings includes the steps of providing a drum unit with a plurality of cutting bit holders secured to its outer cylindrical surface and a plurality of cutting bits that can be repeatedly installed in and removed from the holders. The holders and cutting bits are arranged so as to produce chipping grooves in pavement sufficiently closely spaced for removing pavement markings and a thin layer of underlying pavement, while leaving an acceptably smooth surface. In accordance with the method, the drum unit is mounted in a drive unit on a horizontal rotational axis. The drum unit is rotated, and employed to remove pavement markings by chipping.

In contrast to the relatively coarse bits employed for pavement milling or planing, in accordance with the invention relatively smaller bits, for example carbide tips with a base diameter of approximately ⅝ inch secured to a 0.55 inch diameter shank are employed.

To produce the sufficiently closely spaced chipping grooves on pavement, the holders and cutting bits are arranged in a regular pattern with interlacing (also referred to as "lacing" or "flighting"). The holders and bits produce chipping grooves on pavement that are laterally spaced within approximately ½ inch of each other, center-to-center, and preferably closer. Preferably, the holders and cutting bits are arranged in a repeating chevron pattern, oriented for lateral movement of removed marking and pavement material towards the ends of the unit.

In one embodiment, the drum is approximately sixteen inches wide. For adjustment purposes, depending upon the width of the pavement marking to be removed, cutting bits in selected tracks are removed from their holders, thus decreasing the effective width of the drum.

The invention provides a corresponding tool for removing pavement markings, in the form of a drum unit with a plurality of cutting bit holders secured to its outer cylindrical surface, and a plurality of cutting bits that can be repeatedly installed in and removed from the holders. The holders and cutting bits are arranged so as to produce chipping grooves in pavement sufficiently closely spaced for removing pavement markings and a thin layer of underlying pavement while leaving an acceptably smooth surface, in the same manner as is summarized above.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION

Figure 1:
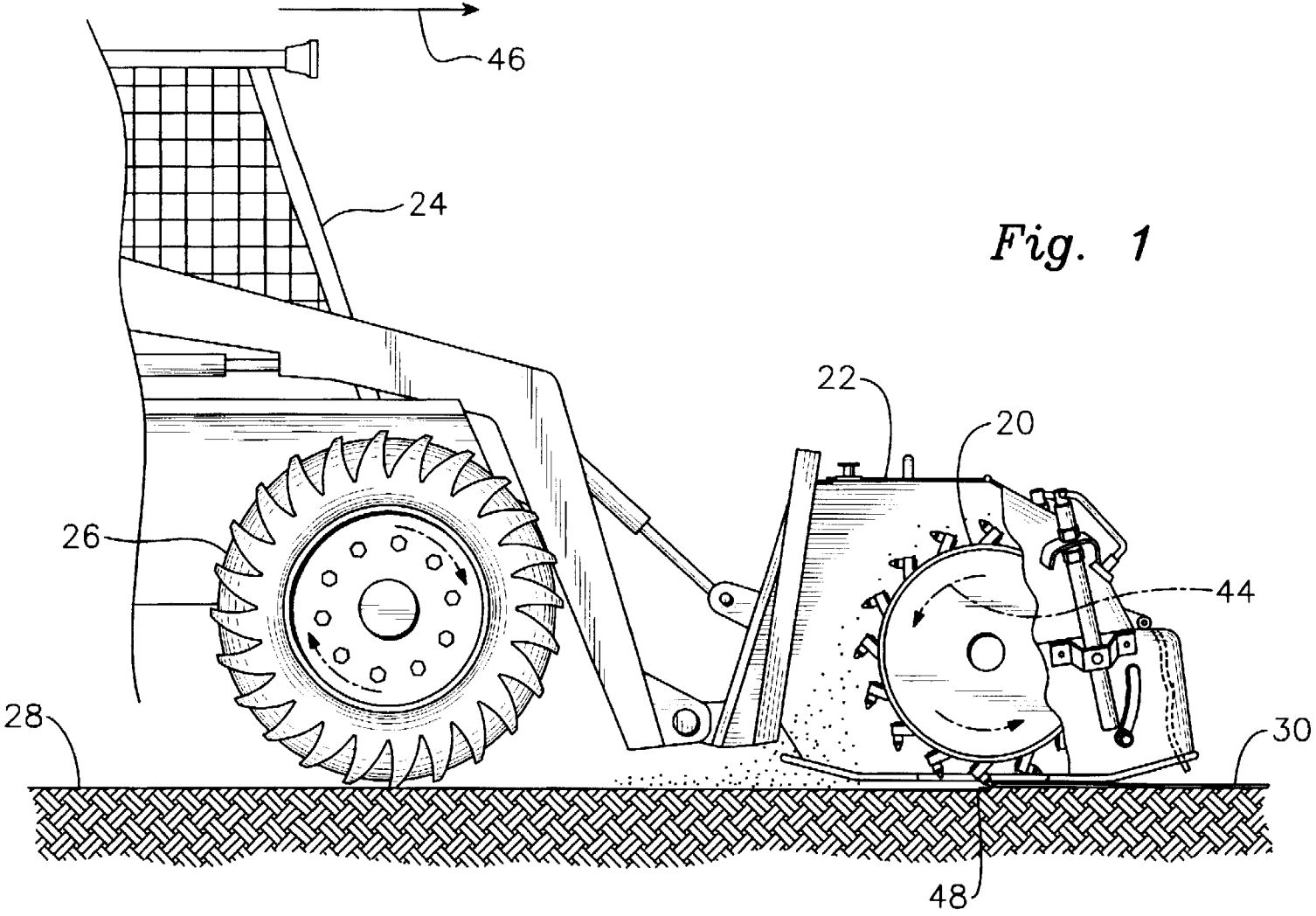
FIG. 1 is a highly schematic representation of a pavement marking removal operation in accordance with the invention.

Referring first to FIG. 1, a drum unit 20 in accordance with the invention is mounted to a driven hub (not shown) within a suitable housing and drive unit, generally designated 22, attached to a vehicle represented at 24, such as a "Bobcat skid-steer loader" equipped with High Flow Hydraulics. The vehicle 24 includes a road wheel 26, for driving the vehicle 24 to the right in the FIG. 1 orientation, and a conventional hydraulic drive connection (not shown) for rotating the drum unit 20 at typical speeds within the approximate range of from 100 to 150 RPM.

In FIG. 1, a pavement surface 28, such as an asphalt or concrete roadway or parking lot, has a pavement marking 30 thereon, which it is desired to remove.

Secured to the outer surface of the drum unit 20 are a plurality of cutting bit holders or blocks 40 holding cutting bits 42, described in greater detail hereinbelow with reference to FIGS. 2–4. By way of example and not limitation, the drum 20 is typically eighteen inches in diameter, and sixteen inches in width.

As indicated by arrow 44, the drum 20 is driven in counterclockwise rotation in the orientation of FIG. 1 while the vehicle 24 and drive unit 22 are propelled forward as represented by arrow 46. The marking 30 and a thin layer of pavement 28 are removed at 48 by chipping. The depth of cut is within the approximate range of ⅛ to ¼ inch, and an acceptably smooth surface is left.

Figure 2:
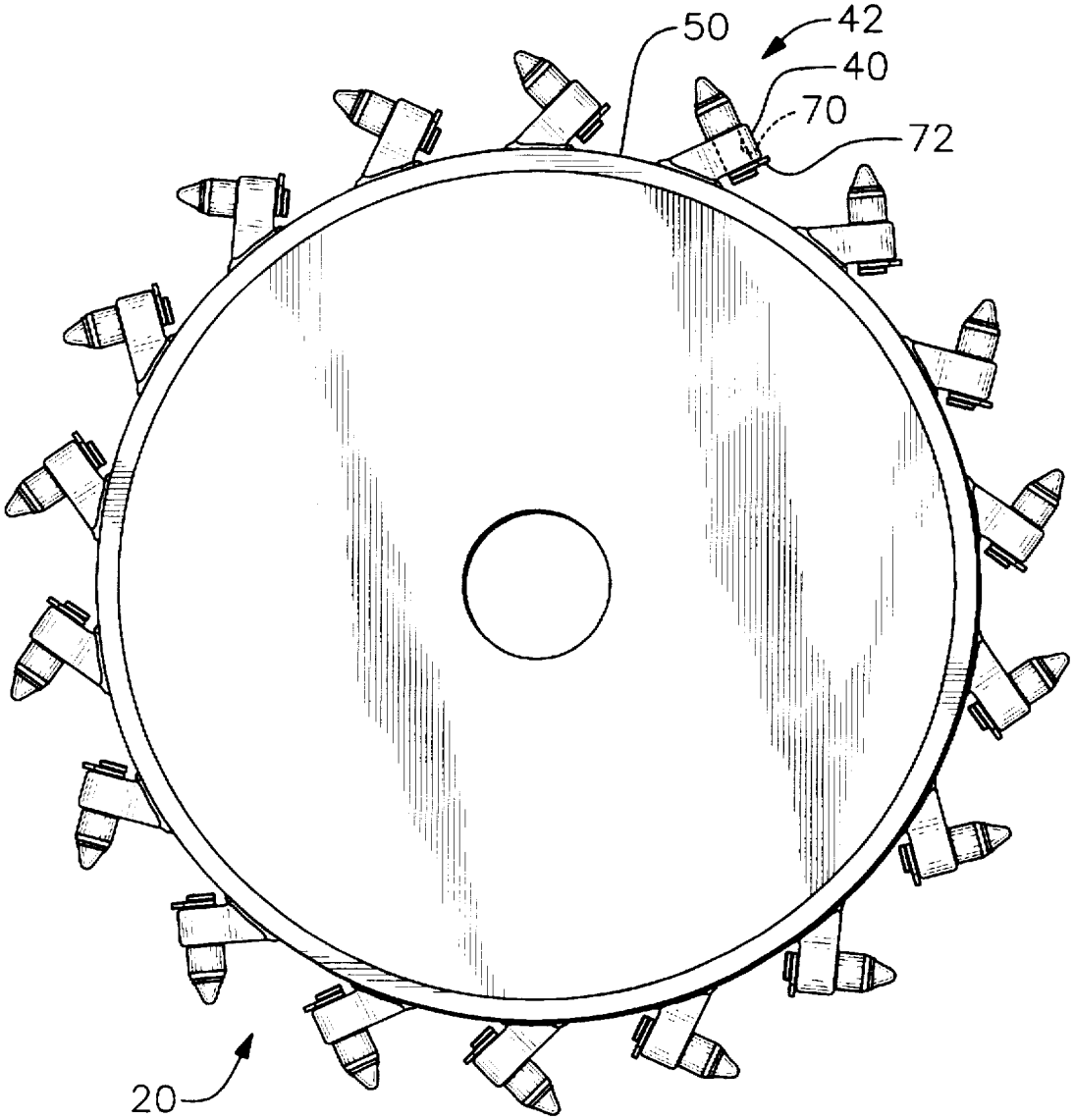
FIG. 2 is a conceptual right side view of a drum unit, depicting cutting bits and blocks secured to the outer cylindrical surface of the drum unit.

FIG. 2 is an enlarged side view conceptually depicting the manner in which blocks 40 and cutting bits 42 are attached to the outer cylindrical surface 50 of the drum 20. FIG. 3 is a further enlarged view and FIG. 4 is a longitudinal cross-sectional view of a single cutting bit 42, which comprises a carbide tip 52 brazed to a steel base 54 including a cylindrical shank 56 with an annular groove 58 at its distal end, and a tip mount portion 60. The tip mount portion 60 includes a recess 62 configured to receive a corresponding locating projection 64 on the underside of the tip 52, and there is a thin layer 66 of a silver based brazing alloy between the recess 62 and the projection 64, securing the tip 52 to the tip mount portion 60. A related cutting bit is disclosed in Ojanen U.S. Pat. No. 4,497,520.

Figure 3:
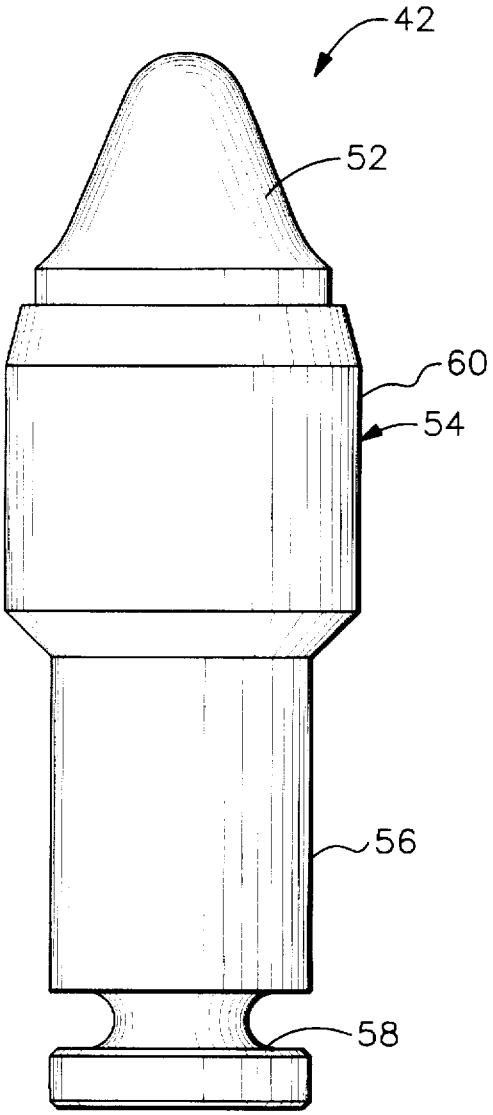
FIG. 3 is a greatly enlarged view of a single cutting bit.
Figure 4:
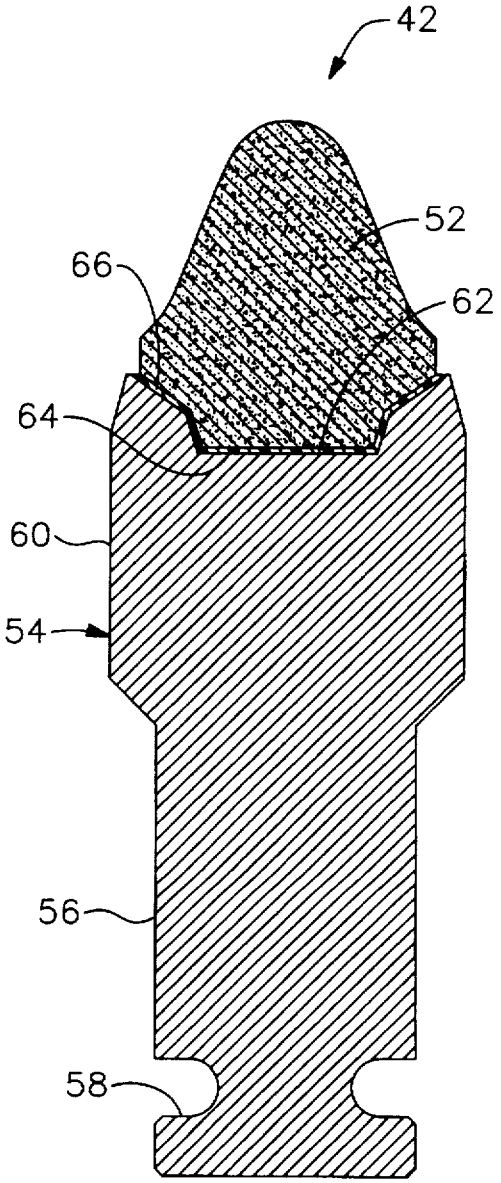
FIG. 4 is a longitudinal cross-sectional view of the cutting bit of FIG. 3.

The overall length of the cutting bit 42 in FIGS. 3 and 4 is about 2¼ inches. The shank 56 has a diameter of 0.55 inches, while the tip mount portion 60 has a diameter of approximately ¾ inch. The carbide tip 52 has a diameter of ⅝ inch at its base, immediately adjacent the locating projection 64, and a length of approximately ½ inch, exclusive of the locating projection 64.

Referring in particular to FIG. 2, the blocks 40 have bores 70 which loosely receive the cutting bit 42 shanks 56, and the cutting bits 42 are retained for repeated installation and removal by means of hair pin clips 72 which engage the annular grooves 58 (FIG. 3). Advantageously, this clip 72 retention facilitates rapid selective removal and installation of cutting bits 42 for purposes of width adjustment. Compared to other pavement marking removal machines, changing of cutting teeth can be accomplished ten times faster.

The blocks 40 are welded to the surface 50 of the drum 20. The bores 70 within the blocks 40 and therefore the cutting bit 42 shanks 56 are oriented at a 45° angle relative to a tangent at the point of attachment. Impact forces during operation are directed generally along the longitudinal axis of the bits 42, without undue sideways force which would cause the bits 42 to bind in the bores 70. The bits 42 accordingly are able to rotate during operation, preventing uneven wear and extending the working life of the bits 42. To encourage rotation of the bits 42 within the bores 70, the blocks 40 are mounted so that the bores 70 and thus the bits 42 are alternatively angled with reference to the direction of drum 20 rotation, at approximately a 5° angle. Suitable blocks 40 are Style CM-1 weld-on blocks available from Fansteel in Lexington, Ky.

Figure 5:
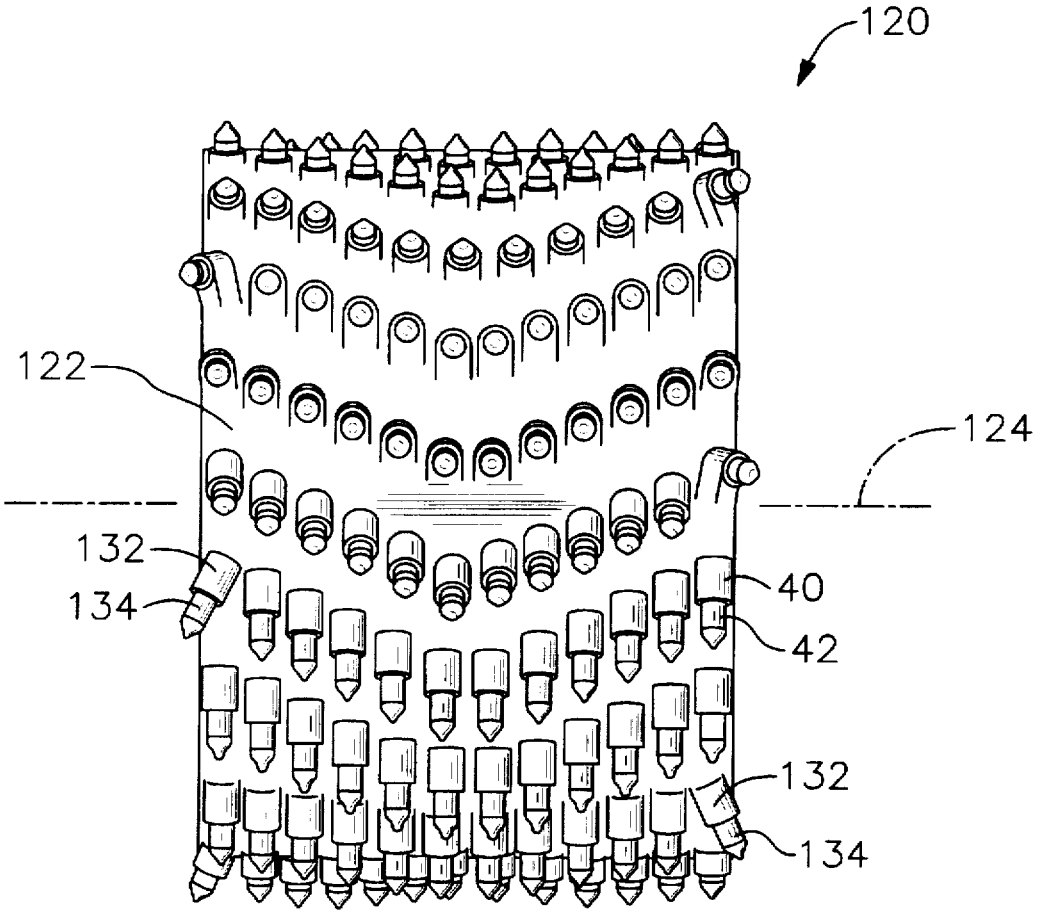
FIG. 5 is a rear elevational view of one embodiment of a drum unit and FIG. 6 is a developed view of a drum surface showing another typical cutting bit pattern.

FIG. 5 is a rear elevational view of one embodiment of a drum unit 120 having a cylindrical surface 122 and a rotational axis 124. The drum unit 120 is made to fit within the FIG. 2 drive unit 22.

In FIG. 5, the cutting bits 42 are arranged in generally V-shaped lines across the width of the drum 120 in a repeating chevron pattern, oriented for movement of removed marking and pavement materials laterally towards the ends of the drum unit 120 as the drum 120 rotates. Although not readily apparent from FIG. 5, to encourage rotation of the bits 42 within the blocks 40 for the purpose of even wear, the blocks 40 are mounted so that the bores 70 and thus the bits 42 are alternatively angled laterally at approximately a 5° angle.

Also visible in FIG. 5 are several blocks 132 and bits 134 at the sides of the drum 120 angled sharply outward so that the bits 134 cut a track wider than the width of the drum 128 for special situations (other than line removal) where it is desired to use the drum 128 to make a deep cut in the pavement. The wider track provides clearance so that the drum 120 can enter into a deep cut. In addition, these blocks 132 and bits 134 at the sides of the drum 120 do not cut as deep as the others, providing the resultant cut in the pavement with a tapered edge.

Normally, the width of the removal pattern is adjusted to match the width of pavement marking to be removed. Accordingly, beginning at the sides of the drum 120, the cutting bits 42 are selectively removed in order to narrow the cutting width as desired.

To produce closely spaced chipping grooves in the pavement, the individual V-shaped lines or chevrons across the width of the drum 120 are arranged at various lateral positions to produce interlacing (also known as "lacing" or "flighting.) As one example, the FIG. 5 drum 120 has eighteen lines or chevrons of blocks 40 and bits 42 around its circumference, with twelve blocks 40 and bits 42 in each line or chevron across the width of the sixteen-inch drum 120. In the absence of interlacing, chipping grooves in the pavement would be approximately $16/12=1\frac{1}{3}$ inches apart, which would be unacceptable for removing pavement markings. In the FIG. 5 drum, although not readily apparent from the drawing, there are three different lateral variations in the positioning of blocks 40 and bits 42 within the V-shaped lines or chevrons, decreasing the pavement chipping groove spacing by at least a factor ⅓, to a distance of less than approximately ½ inch between chipping grooves in the pavement, measured center-to-center. The chipping grooves in the pavement overlap laterally, merging into each other, so that no part of the original pavement surface remains between chipping grooves.

Although a chevron pattern is illustrated, and is presently preferred, it will be appreciated that a variety of other patterns may be employed, preferably patterns which tend to move removed materials laterally toward the ends of the drum 120 as it rotates.

Figure 6:
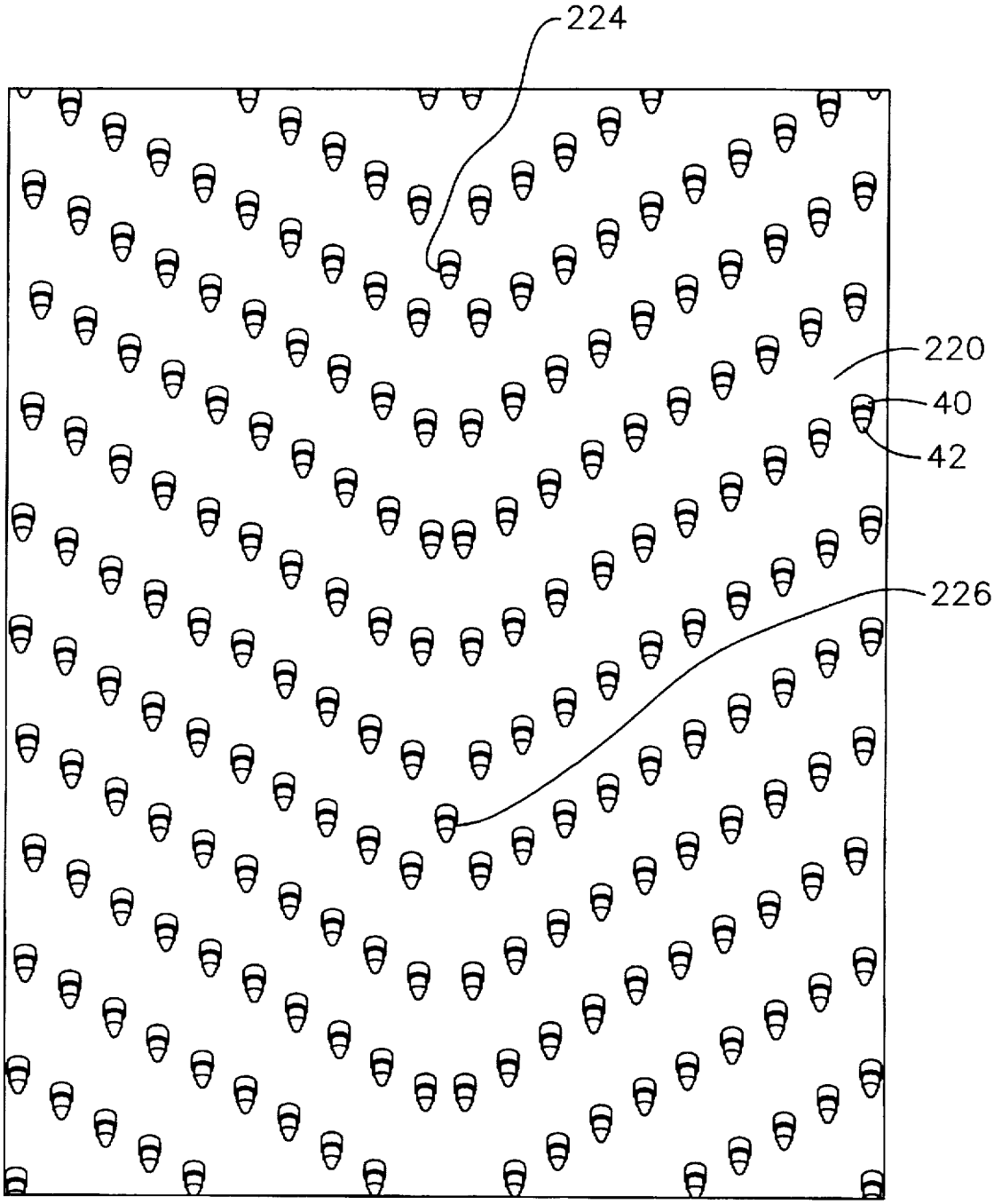

FIG. 6 is a developed view (i.e. flat layout) of the cylindrical surface 220 of another drum, depicting a typical pattern of blocks 40 and cutting bits 42. As illustrated, the cutting bits 42 are arranged in a repeating chevron pattern, oriented for movement of removed marking and pavement materials laterally towards the ends of the drum unit. Again, although not readily apparent from the drawing, to induce rotation of the bits 42 within the blocks 40 for the purpose of even wear, the blocks 40 are mounted so that the bores 70 and thus the bits 42 are alternatively angled laterally at approximately a 5° angle.

In FIG. 6, there are ten V-shaped lines or chevrons of blocks 40 and cutting bits 42, with twenty blocks 40 and bits 42 in each chevron. The lateral shifting to produce interlacing is evident in FIG. 6, and there are two additional bits 224 and 226 laterally centered to fill in the pattern. When employed on a drum sixteen inches wide, the interlaced pattern of FIG. 6 produces pavement chipping grooves spaced less than ¼ inch apart, measured center-to-center.

Normally, the width of the removal pattern is adjusted to match the width of pavement marking to be removed. Accordingly, beginning at the sides of the drum, the cutting bits 42 are selectively removed on a track-by-track basis in order to narrow the cutting width as desired.

Although a chevron pattern is illustrated, and is presently preferred, it will be appreciated that a variety of other patterns may be employed, preferably patterns which tend to move removed materials toward the ends of the drum as it rotates.

While specific embodiments of the invention have been illustrated and described herein, it is realized that numerous modifications and the changes will occur to those skilled in the art. It is therefore to be understood that the appended claims are intended to cover all such modifications and changes as fall within the true spirit and scope of the invention.

What is claimed is:

1. A method for removing pavement markings, said method comprising:

providing a drum unit with a plurality of cutting bit holders secured to its outer cylindrical surface and a plurality of cutting bits that can be repeatedly installed in and removed from the holders, the holders and cutting bits being arranged so as to produce chipping grooves in pavement sufficiently closely spaced for removing pavement markings and a thin layer of underlying pavement while leaving an acceptably smooth surface, and the holders and cutting bits being arranged in a repeating chevron pattern oriented for lateral movement of removed marking and pavement material towards the ends of the drum unit;

mounting the drum unit in a drive unit on a horizontal rotational axis; and rotating the drum unit and employing the rotating drum unit to remove pavement markings.

2. The method of claim 1, wherein the holders and cutting bits are arranged so as to produce chipping grooves on pavement that are laterally spaced within approximately ½ inch of each other center-to-center.

3. A method for removing pavement markings, said method comprising:

providing a drum unit with a plurality of cutting bit holders secured to its outer cylindrical surface and a plurality of cutting bits that can be repeatedly installed in and removed from the holders, the holders and cutting bits being arranged in a regular pattern with interlacing so as to produce chipping grooves in pavement sufficiently closely spaced for removing pavement markings and a thin layer of underlying pavement while leaving an acceptably smooth surface, and the holders and cutting bits being arranged in a repeating chevron pattern oriented for lateral movement of removed marking and pavement material towards the ends of the drum unit;

mounting the drum unit in a drive unit on a horizontal rotational axis; and rotating the drum unit and employing the rotating drum unit to remove pavement markings.

4. The method of claim 3, wherein the holders and cutting bits are arranged so as to produce chipping grooves on pavement that are laterally spaced within approximately ½ inch of each other center-to-center.

5. A tool for removing pavement markings, comprising a drum unit with a plurality of cutting bit holders secured to its outer cylindrical surface and a plurality of cutting bits that can be repeatedly installed in and removed from said holders, said holders and cutting bits being arranged so as to produce chipping grooves in pavement and sufficiently closely spaced for removing pavement markings and a thin layer of underlying pavement while leaving an acceptably smooth surface, and said holders and cutting bits being arranged in a repeating chevron pattern oriented for lateral movement of removed marking and pavement material towards the ends of said drum unit as said drum unit is rotated.

6. The tool of claim 5, wherein said holders and cutting bits are arranged so as to produce chipping grooves on pavement that are laterally spaced within approximately ½ inch of each other center-to-center.

7. A tool for removing pavement markings, comprising a drum unit with a plurality of cutting bit holders secured to its outer cylindrical surface and a plurality of cutting bits that can be repeatedly installed in and removed from said holders, said holders and cutting bits being arranged in a regular pattern with interlacing so as to produce chipping grooves in pavement and sufficiently closely spaced for removing pavement markings and a thin layer of underlying pavement while leaving an acceptably smooth surface, and said holders and cutting bits being arranged in a repeating chevron pattern oriented for lateral movement of removed marking and pavement material towards the ends of said drum unit as said drum unit is rotated.

8. The tool of claim 7, wherein said holders and cutting bits are arranged so as to produce chipping grooves on pavement that are laterally spaced within approximately ½ inch of each other center-to-center.

* * * * *